US005282635A

United States Patent [19]

Hopkins

[11] Patent Number: 5,282,635

[45] Date of Patent: Feb. 1, 1994

[54] MARKER TOSS GAME

[76] Inventor: Randolph M. Hopkins, 1741 Ocean Dr., McKinleyville, Calif. 95521

[21] Appl. No.: 59,742

[22] Filed: May 11, 1993

[51] Int. Cl.[5] ..... A63B 67/06

[52] U.S. Cl. ..... 273/342; 273/400

[58] Field of Search ..... 273/342, 398, 400, 401, 273/402, 85 R

[56] References Cited

U.S. PATENT DOCUMENTS

| | | | |
|---|---|---|---|
| 2,344,737 | 3/1944 | Schlesinger . | |
| 3,306,615 | 2/1967 | Tack | 273/400 |
| 3,837,648 | 9/1974 | Breslow | 273/342 |
| 3,876,070 | 4/1975 | Nagy . | |
| 4,126,309 | 11/1978 | Hicks et al. . | |
| 4,239,221 | 12/1980 | Griffin | 273/127 R |
| 4,288,076 | 9/1981 | Oyague et al. | 273/126 R |
| 4,392,653 | 7/1983 | Blume, Sr. | 273/400 |
| 4,726,592 | 2/1988 | Callaham | 273/342 |

*Primary Examiner*—William H. Grieb
*Attorney, Agent, or Firm*—Richard C. Litman

[57] ABSTRACT

A game involving the tossing or pitching of a marker(s) onto a board having numbers marked thereon and representing possible pin counts in the game of bowling, is scored using the scoring system developed for bowling. Areas of equal size are marked with the numbers one through eight, with a central cup having a value of ten points; a concentric area around the cup has a value of nine. Players toss markers, such as a twenty five cent coin, toward the board and attempt to bounce the marker off of the board surface and into the raised cup to score a strike. The cup is removable from the underlying retainer portion to facilitate the removal of any markers or coins which land therein. Various possible marker positions are provided for in the scoring. The board and central cup may be constructed to any scale deemed suitable or desired.

17 Claims, 1 Drawing Sheet

FIG. 1
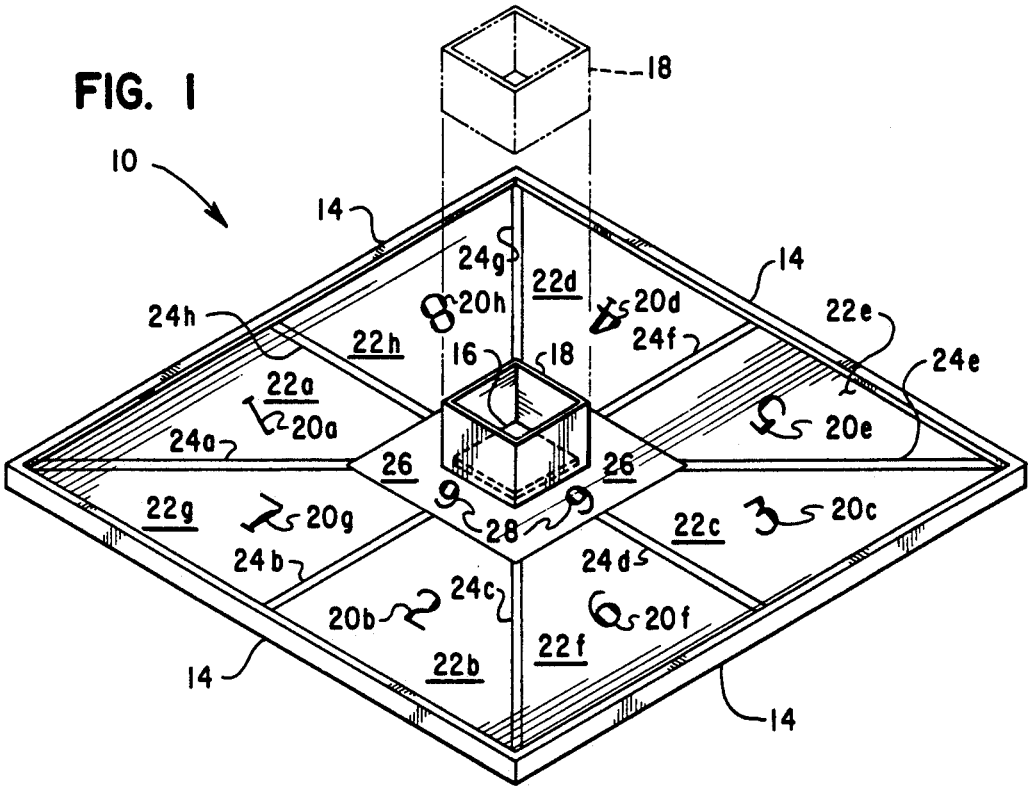
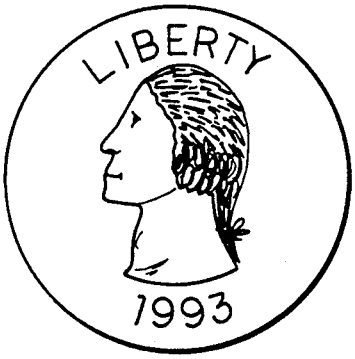
FIG. 2
12
FIG. 3
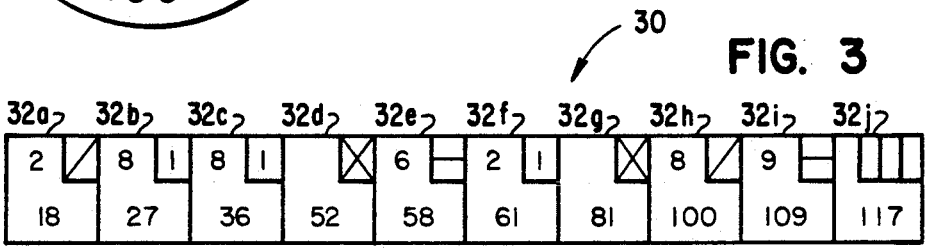

MARKER TOSS GAME

FIELD OF THE INVENTION

The present invention relates generally to games of skill involving the pitching or tossing of a marker(s) at a target, and more specifically to such a game providing for scoring in a manner simulating bowling.

BACKGROUND OF THE INVENTION

The urge for individuals to compete has led to the development of numerous games, sports and contests over the years. While many of these games test only or predominantly the mental capabilities of the competitors, games involving the physical skills of the competitors are also widely known. However, most such games require relatively large areas or expensive facilities and equipment in order to be played properly; bowling is a good example of such a game of skill.

On the other hand, various informal games have been developed which test physical skills off one sort or another, but do not require extensive facilities or equipment; an example is the old game of tossing or pitching pennies or other coins to the base of a wall. While there is undeniably some skill involved in such a game, the lack of any other rules or goals generally result in the players losing interest in short order.

The need arises for a game of skill combining many of the more challenging aspects of the game of bowling and using the scoring system therefor, which may be played in a limited space or area and using limited equipment. The game should be playable by any practicable number of players from one upwards, and must be playable by players of various skill levels. The scoring system should provide for the quantifying of the skill level of the player(s).

DESCRIPTION OF THE PRIOR ART

U.S. Pat. No. 2,344,737 issued to Ralph M. Schlesinger on Mar. 21, 1944 discloses a Game Board having several embodiments. Corner pockets or side recesses are included in each of the embodiments; playing pieces are tossed and collect within the recesses of the playing board(s). No rules of play or method of scoring are disclosed.

U.S. Pat. No. 3,306,615 issued to Oscar F. Tack on Feb. 28, 1967 discloses a Toss Game Simulating Bowling. Rather than a single token or coin being tossed per each play, ten markers are tossed simultaneously at a target representing bowling pins. No numbers are marked on the board to be used to determine the score of a play; the markers landing and remaining within a specified area are counted to determine the score for that play. The scoring is like that used for bowling.

U.S. Pat. No. 3,876,070 issued to Bela Nagy on Apr. 8, 1975 discloses Tiered Target, Disc-Shaped Projectiles And Carrying Case. Markers or discs are tossed toward the target, with the object being to have the markers alight and rest upon the uppermost tier to provide the greatest score. No other cumulative means of keeping score is disclosed, nor other details such as the number of players and/or playing pieces, number of tosses per play, etc.

U.S. Pat. No. 4,126,309 issued to Alan A. Hicks et al. on Nov. 21, 1978 discloses a Rotatable Target Game Device in which the multiple targets are disposed in a moving platform. The projectiles are dropped through rings toward the rotating targets.

U.S. Pat. No. 4,239,221 issued to Albert N. Griffin on Dec. 16, 1980 discloses a Game Device including a horizontal target with concentric rings, into which dice are rolled. Scoring may simulate that used for several different games, but does not lend itself to ready adaptation to bowling scoring due to the limited numbers.

U.S. Pat. No. 4,288,076 issued to Ralph Oyague et al. on Sep. 8, 1981 discloses a Foldable Gameboard And Disc Playing Piece Apparatus. Each player uses a different marker, and the markers are propelled by a mechanical device toward numbered areas on a board; the markers are projected from a starting point on the board. No specific scoring system is disclosed.

Finally, U.S. Pat. No. 4,726,592 issued to Bayliss O. Callaham on Feb. 23, 1988 discloses an Amusement Device And Method For Use. The device comprises a cruciform pattern with a central cup. The object is to bounce a ball from one of the legs, thence to rebound into the cup. No scoring system is disclosed, other than noting that a record is kept of successful plays.

None of the above noted patents, taken either singly or in combination, are seen to disclose the specific arrangement of concepts disclosed by the present invention.

SUMMARY OF THE INVENTION

By the present invention, an improved marker toss game is disclosed.

Accordingly, one of the objects of the present invention is to provide a marker toss game in which one or more players toss one or more markers toward designated target areas marked on a board.

Another of the objects of the present invention is to provide an apparatus for such a marker toss game.

Yet another of the objects of the present invention is to provide a marker toss game including a rectangular board having a plurality of numerically marked areas radially disposed from the center with the numbers representing scoring values, and radially disposed dividing lanes between each of the numerically marked areas extending radially from the center of the board.

Another object of the present invention is to provide such a game board in which adjacent sets of two numbers on each side of the board have the same total value as adjacent sets of two numbers on each of the other sides of the board.

Still another of the objects of the present invention is to provide such a game board which includes a central container or box representing a highest value or score.

An additional object of the present invention is to provide such a game board in which the central container or box is removable, and which further includes means for retaining the central box in position during the course of play and peripheral retaining means to prevent markers from leaving the board.

A further object of the present invention is to provide a marker toss game in which the markers may be coins.

And another object of the present invention is to provide a game in which the numbers and central container on the board may be used in scoring in the manner of scoring in the game of bowling.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 1 is a perspective view of the game board of the present invention, showing the layout of the board and the removable central cup or box.

FIG. 2 is an enlarged scale drawing of a marker or token, such as a coin, which may be used to toss toward the board during play.

FIG. 3 is a scoresheet showing a typical score achieved during the play of the game, and scored in the manner of bowling.

Similar reference characters denote corresponding features consistently throughout the several figures of the attached drawings.

DETAILED DESCRIPTION OF THE PREFERRED EMBODIMENT

Referring now particularly to FIG. 1 of the drawings, the present invention will be seen to relate to a marker toss game including a game board 10 and one or more markers 12 (shown in FIG. 2) therefor. Game board 10 is formed of a preferably square planar sheet of material, such as wood, although other materials may be used as desired. Game board 10 includes a raised peripheral border 14 at the outer edge thereof; an additional raised area 16 is located at the center of the board 10, for the purpose of retaining an open cup or box 18. A series of eight numbers 20*a* through 20*h* are marked on the board 10 in areas 22*a* through 22*h* respectively, and are separated from one another by eight radial dividing lanes 24*a* through 24*h*. Radial lanes 24*a*, 24*c*, 24*e*, and 24*g* are diagonally disposed upon board 10, while alternate radial lanes 24*b*, 24*d*, 24*f*, and 24*h* serve to bisect each of the four sides of board 10. Each radial lane 24*a* through 24*h* is preferably at least as wide as the marker or token 12 used in the play of the present game in order to preclude a token 12 coming to rest in contact with two adjacent areas, e.g. 22*g* and 22*b*, to avoid ambiguity in scoring. An addition square area 26 surrounds the raised central area 16 and open box 18 removably positioned thereon, and is marked with the number nine, indicated by the callout 28 on the drawings. It will be seen that adjacent numbers on each side of the board 10 have a total value of nine, in order to provide equal scoring opportunity for players positioned around the board.

Cup 18 will be seen to have a square planform with an open top and bottom. The inside shape and area of cup 18 is substantially equal to the shape and area of the raised central area 16, and cup 18 is precluded from lateral movement over the surface of board 10 by means of its close fit over the fixed central area 16 when installed thereon. The reason for this construction will be explained further below, in the discussion of the play of the game.

The above description of the pattern of markings on board 10 will be seen to provide a series of eight trapezoidal areas 22*a* through 22*h* having equal sizes, with areas 22*a* through 22*d* being congruent to one other and alternating areas 22*e* through 22*h* also being congruent to one other but mirror images of areas 22*a* through 22*d*. Thus, if all other factors and conditions are equal, there will be an equal chance of a marker 12 landing upon any of the above areas 22*a* through 22*h*. However, area 26 will be seen to provide a smaller area, and thus a more difficult target, than the other areas 22*a* through 22*h* discussed above.

The area circumscribed by cup 18 and defined by the raised central area 16 will also be seen to define a specific area which is smaller than any of the other areas of board 10. Accordingly, the area of central area 16 will prove even more difficult to hit with a marker 12 during the course of play. Area 16 represents a value of 10. This is a realistic representation of the game of bowling, wherein it is more difficult to knock down all ten pins with a single ball (i.e., score a "strike") than to knock down some lesser number.

The present game is scored using a bowling line score sheet 30 having ten frames 32*a* through 32*j*, as shown in FIG. 3 of the drawings. The score recorded in score sheet 30 represents a typical round of play of the present game, and will be used to describe the method of play of the present game. Each player will have his or her own line score sheet 30 on which to record their score, just as in the game of bowling. The game is played by having each player, in turn, toss or pitch a token (which may be of any sort, e.g. the quarter coin represented in FIG. 2) toward the board 10 and attempting to bounce the token 12 from one of the radial dividing lanes 24*a* through 24*h* and into the cup 18. The resulting score will depend upon the value determined by the number 20*a* through 20*h* or 26 respectively within the numbered area 22*a* through 22*h*, 26, or area 16 within cup 18, upon or within which the marker 12 comes to rest. (Area 16 has a value of ten and is equivalent to a strike in bowling.) Tokens or markers centered upon a dividing lane 24*a* through 24*h* are not scored and are tossed again. Tokens resting upon the border between area 26 and areas 22*a* through 22*h* are awarded the lower of the two values (e.g., a token resting upon the line between area 26 and area 22*b*, having a value of two, would count as two). Tokens on the edge of an area 22*a* through 22*h* are awarded the value of that area, with the exception that tokens leaning on the raised peripheral edge 14 or against the cup 18 are considered a spare, and scored as such in the manner of bowling scoring. Finally, a token coming to rest completely within or upon the edge of cup 18, is counted as a strike; the cup 18 is removable from the board 10 in order to facilitate the removal of markers, tokens or coins 12 from the relatively small area 16. Each player has two tosses per each frame 32*a* through 32*j* (with a possible additional toss in the tenth frame 32*j*, as in bowling) and attempts to make a score of ten in each frame without exceeding that number. The single exception to the similarity of the scoring of the present game to the scoring system used in bowling, is that it is possible for a player to accumulate a score exceeding a value of ten for two tosses in a single frame; e.g., tokens respectively landing upon area 22*g*, having a value of seven, and 22*h*, having a value of eight. When this occurs, the second toss is awarded no points; this is equivalent to a "gutter ball" or total miss in bowling.

The order of play is determined by each player in turn attempting to bounce a single token or marker 12 from one of the dividing lanes 24 to rest upon the board 10, with the player having the highest score proceeding first in the actual play of the game and other players positioned around the board 10 taking their respective turns in a clockwise order. Ties during the determination of the order of play are broken by repeating the process among the tied players.

The following explanation will describe the scoresheet 30 for only a single player; it will be understood that any number of players may play, taking consecutive turns and each respectively recording their score on their own scoresheets, or having a player or other person act as a designated scorekeeper for all of the players. In the example of the scoresheet 30 of FIG. 3, the player made a first toss which came to rest upon area 22*b*, having a value of two as shown in the upper left portion of frame 32*a*, and a second toss which came to rest upon area 22*h*, having a value of eight. The total value of ten points scored in two tosses is equivalent to knocking down all ten pins with two balls in bowling, and is accordingly marked with a spare symbol in the upper right corner of frame 32*a* just as in the manner of bowling scoring. Accordingly, the value of the next toss is added to the ten for the first frame, just as in bowling.

The first toss of the second frame 32*b* landed in area 22*h* of board 10, having a value of eight points. This number is marked in the upper left area of frame 32*b*, and is added to the ten points scored for the spare of the first frame 32*a* for a score of eighteen in the first frame. The second toss for the second frame 32*b* will be seen to have landed in area 22*a*, having a value of only one and resulting in a total score of nine for the second frame. The cumulative score of twenty seven is recorded in the second frame 32*b*, as indicated. The third frame 32*c* shows an identical result.

In the fourth frame 32*d*, the player was successful in bouncing his or her marker 12 from the surface of the board 10 and causing it to come to rest in or on the edge of the cup 18, thereby scoring a strike. As the maximum value of ten has been achieved with only one toss, no second toss is needed for this frame.

In the fifth frame 32*e*, the marker 12 comes to rest in area 22*f*, having a value of six. However, the next toss will be seen to either miss the board 10 entirely, or to come to rest upon an area whose value, when added to the six already attained, exceeds the maximum allowable total of ten for a single frame. In this event, the second toss is not scored, and a horizontal line is marked in the upper right box of the frame; only the six resulting from the first toss is recorded. In bowling scoring, the count from the next two balls following a strike are added to the ten for the strike; this is also the case with the present game. However, since the second toss following the strike scored zero points, only the six points from the first toss of the fifth frame 32*e* are added to the strike of the fourth frame 32*d*.

The remaining scoring shown in line score sheet 30 will be seen to continue according to the system described above and used in scoring in bowling. It will be noted, for example, that another strike was scored in the seventh frame 32*g*, and the next two tosses (resulting in a total of ten points, or a spare) are added to the ten points for the strike to increase the score in frame 32*g* by a total of twenty points over the previous frame 32*f*. As strikes require the score achieved by the following two tosses to be added thereto, an additional two boxes are provided in the upper right corner of the tenth frame 32*j* for scoring such an eventuality. In the example of the present game, it will be seen that a total of eight points was scored in the tenth frame, rather than a strike or spare.

In accordance with the above apparatus and method of play, a coin or marker tossing game is provided which achieves much of the excitement and interest of the game of bowling, and which can be every bit as demanding in the form of physical skill and dexterity, but which may be played in a very limited area and with no additional equipment other than the board 10 with its cup 18 and a single marker, token or coin 12. Alternatively, coins or markers 12 used in the play of the present game may be awarded to the player or players achieving the highest score in a given frame, or may be awarded to the player having the best score at the end of a full game of ten frames. Tournament play may be conducted in accordance with the procedures established for bowling tournaments, in that the rules are closely related. While no specific size for the board 10 or cup 18 is described herein, it will be seen that the board 10 and cup 18 and markings thereon may be made to any scale deemed suitable or desired; for example, a board size of some two feet across, and a cup measuring some three inches across, may be suitable for relatively small areas. On the other hand, the game of the present invention may be played in larger areas, and the various components and markings, as well as the markers to be tossed or pitched, scaled up accordingly.

It is to be understood that the present invention is not limited to the sole embodiment described above, but encompasses any and all embodiments within the scope of the following claims.

I claim:

1. A marker tossing game for at least one player simulating the game of bowling and including:

a generally planar game board having four sides and a square plan form, a raised peripheral border along each of said four sides, and a raised central area;

a removable cup installable over said raised central area and retained thereby upon said board;

at least one marker; and at least one bowling line score sheet for each player, whereby;

a player tosses said marker toward said board in an attempt to bounce said marker from a portion of said board into said cup, with the resulting position of said marker providing a score which is recorded on said bowling line score sheet.

2. The game of claim 1 wherein:

said board includes a plurality of radially disposed areas extending outwardly to said four sides of said raised peripheral border, and a concentric area peripheral to said raised central area, said radially disposed areas and said concentric area each having a value of from one to nine.

3. The game of claim 2 wherein:

said plurality of radially disposed areas comprises eight equally sized areas having trapezoid shapes, with each said equally sized area having a value of from one to eight.

4. The game of claim 3 wherein:

each two adjacent said equally sized areas extending to each of said four sides have a total value of nine.

5. The game of claim 2 wherein:

said concentric area and said central area each respectively have values of nine and ten.

6. The game of claim 2 including:

a radially disposed division lane between each of said radially disposed areas.

7. The game of claim 1 wherein:

said marker comprises a coin.

8. The game of claim 7 wherein:

said coin is a U.S. twenty five cent coin.

9. The game of claim 1 wherein:

said board includes a plurality of radially disposed areas extending outwardly to said four sides of said raised peripheral border, a radially disposed division lane between each of said radially disposed areas, and at least one marker.

10. The game of claim 9 wherein:

each said radially disposed division lane is at least as wide as said marker.

11. A method of playing a marker toss game by at least one player simulating the game of bowling and using the scoring system of the game of bowling, said method comprising the following steps:

providing a planar, square game board having a raised central area, a raised border, a removable cup installable over the raised central area and having a value of ten therein, an area concentric to said raised central area and having a value of nine, a plurality of radially disposed areas extending outwardly to said raised border and each respectively having a value of from one to eight, and a radially disposed division lane between each of the radially disposed areas;

further providing at least one marker and at least one bowling line score sheet for each player;

determining an order of play for each player by having each player in turn attempt to land the marker in an area of relatively high value by bouncing the marker from one of the division lanes to another area of the board, with the player having the marker land upon the area having the highest value proceed first in the play of the game;

each player in turn attempting to achieve a score by tossing the marker and bouncing the marker from one of the division lanes to another area of the board, and recording the resulting value of the area of the board upon which the marker comes to rest on a bowling line score sheet in accordance with the scoring system used in the game of bowling; and continuing in the above manner until each player has completed a game, with the player having the highest score at the end of the game being the winner of the game.

12. A method of playing a marker toss game according to claim 11, further providing a marker comprising a coin.

13. A method of playing a marker toss game according to claim 12, further providing a coin comprising a U.S. twenty five cent coin.

14. A method of playing a marker toss game according to claim 11, further providing a marker for each player for each toss during the course of the game, with a player having the highest score at the end of the game collecting all of the markers.

15. A method of playing a marker toss game according to claim 14, further providing a marker comprising a coin.

16. A method of playing a marker toss game according to claim 15, further providing a coin comprising a U.S. twenty five cent coin.

17. A method of playing a marker toss game according to claim 11, further including the step of canceling any score for a second toss in one turn which results in a total score for the two tosses of the one turn exceeding a value of ten.

* * * * *